US012024991B2

(12) United States Patent
Samuel et al.

(10) Patent No.: US 12,024,991 B2
(45) Date of Patent: Jul. 2, 2024

(54) INTELLIGENT RIG STATE DETECTION AND UNCERTAINTY ANALYSIS ON REAL-TIME DRILLING PARAMETERS

(71) Applicant: LANDMARK GRAPHICS CORPORATION, Houston, TX (US)

(72) Inventors: Robello Samuel, Cypress, TX (US); Vanessa Ndonhong Kemajou, Spring, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 394 days.

(21) Appl. No.: 17/626,940

(22) PCT Filed: Jan. 14, 2020

(86) PCT No.: PCT/US2020/013536

§ 371 (c)(1),
(2) Date: Jan. 13, 2022

(87) PCT Pub. No.: WO2021/034347

PCT Pub. Date: Feb. 25, 2021

(65) Prior Publication Data

US 2022/0259966 A1 Aug. 18, 2022

Related U.S. Application Data

(60) Provisional application No. 62/890,472, filed on Aug. 22, 2019.

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 21/08* (2013.01); *E21B 47/00* (2013.01); *E21B 2200/20* (2020.05)

(58) Field of Classification Search
None
See application file for complete search history.

(56) References Cited

U.S. PATENT DOCUMENTS 6,179,067 B1 * 1/2001 Brooks ..... E21B 47/022 175/45
10,228,987 B2 * 3/2019 Hanak ..... G05B 19/404
(Continued)

FOREIGN PATENT DOCUMENTS

WO 2018029454 A1 2/2018

OTHER PUBLICATIONS

International Search Report and Written Opinion for International application No. PCT/US2020/013536, mailed May 21, 2020, 9 pages.

*Primary Examiner* — Lina Cordero
(74) *Attorney, Agent, or Firm* — NOVAK DRUCE CARROLL LLP

(57) ABSTRACT

Systems, methods, and computer-readable media are provided for rig monitoring and in particular, to receiving data from a plurality of sensors in real-time, mapping the data from the plurality of sensors with a micro-activity and a macro-activity, generating a message based on the mapping of the data from the plurality of sensors with the micro-activity and the macro-activity, selecting a parameter to be compared with a bit depth, tuning the parameter and the bit depth with a corresponding model based on the message, generating a parameter uncertainty array and a bit depth uncertainty array based on the tuning of the parameter and the bit depth, and generating dynamic uncertainty ellipses based on the parameter uncertainty array and the bit depth uncertainty array.

20 Claims, 9 Drawing Sheets

(51) Int. Cl.
*E21B 21/08* (2006.01)
*E21B 47/00* (2012.01)

(56) References Cited

U.S. PATENT DOCUMENTS

| | | | | |
|---|---|---|---|---|
| 2003/0046005 | A1* | 3/2003 | Haarstad | E21B 47/022 702/9 |
| 2004/0256152 | A1 | 12/2004 | Dashevskiy et al. | |
| 2013/0144531 | A1 | 6/2013 | Johnston | |
| 2013/0197877 | A1* | 8/2013 | Lu | G01V 99/00 703/2 |
| 2014/0244176 | A1* | 8/2014 | Hanak | G01V 3/38 702/9 |
| 2015/0300151 | A1 | 10/2015 | Mohaghegh | |
| 2017/0211954 | A1 | 7/2017 | Dykstra et al. | |
| 2018/0329093 | A1* | 11/2018 | Kusko | G01V 1/137 |
| 2019/0106982 | A1* | 4/2019 | Willerth | E21B 7/04 |

* cited by examiner

INTELLIGENT RIG STATE DETECTION AND UNCERTAINTY ANALYSIS ON REAL-TIME DRILLING PARAMETERS

CROSS-REFERENCE TO RELATED APPLICATIONS

This application is a national stage entry of PCT/US2020/013536 filed Jan. 14, 2020, which claims priority to U.S. Provisional Patent Application 62/890,472, which was filed in the U.S. Patent and Trademark Office on Aug. 22, 2019, both of which are incorporated herein by reference in their entirely for all purposes.

TECHNICAL FIELD

The present technology pertains to rig monitoring and in particular, to the use of real-time predictive analysis to improve the monitoring of drilling operations, as well as the prediction of drilling parameters based on prior data and their relationship.

BACKGROUND

Real-time well engineering is a major need for the oil and gas industry. However, current software is limited to real-time activity monitoring, which does not inherently prevent non-productive time or invisible loss time during the execution phase of a well.

Additionally, conventional monitoring techniques make no significant effort toward predictive and/or prescriptive analysis.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
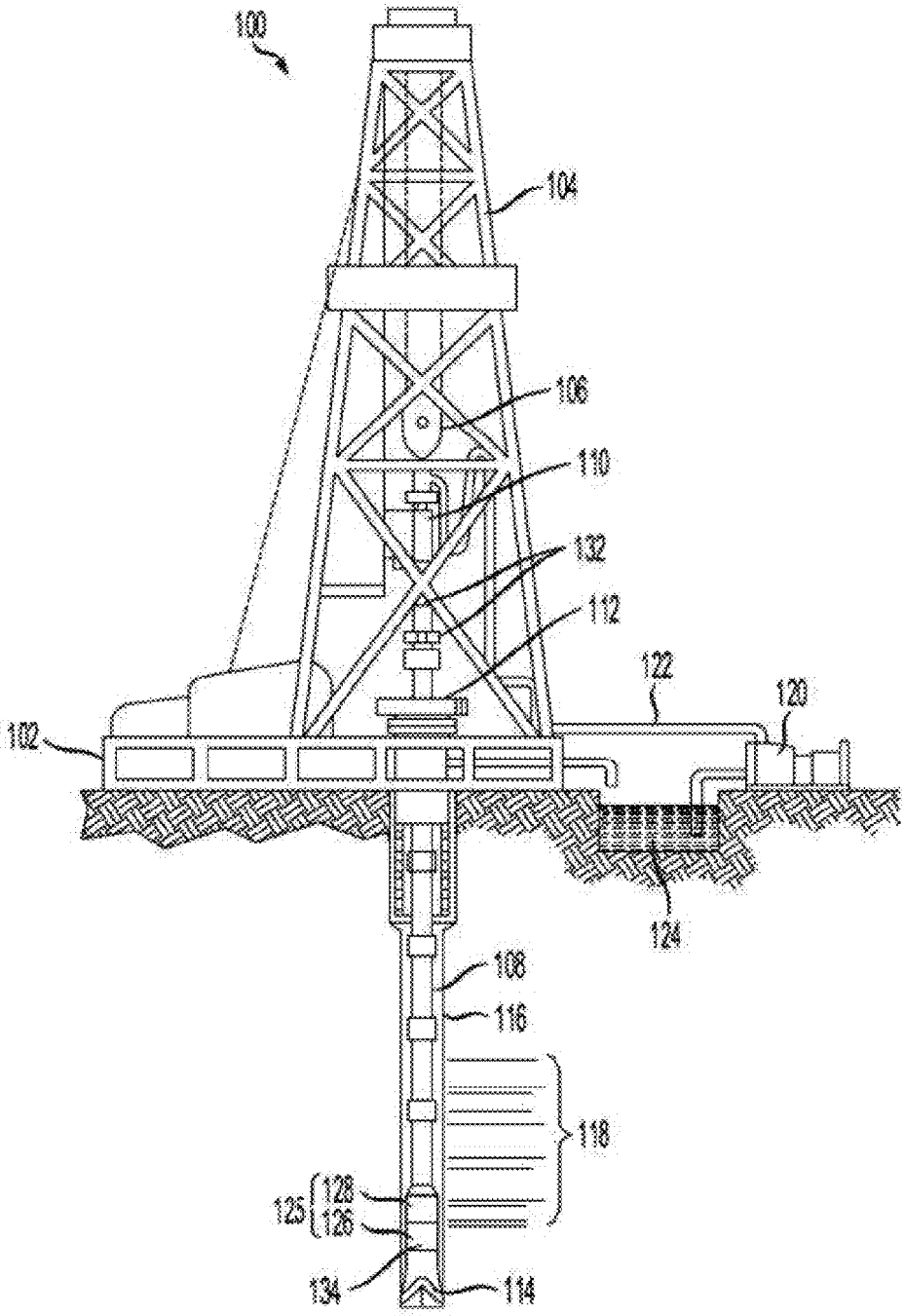
FIG. 1A is a schematic diagram of an example logging while drilling (LWD) wellbore operating environment, in accordance with some examples.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed are systems, methods, and computer-readable storage media for using a real-time predictive analysis to improve monitoring of drilling operations.

According to at least one aspect, an example method for using a real-time predictive analysis to improve monitoring of drilling operations is provided. The method can include receiving data from a plurality of sensors in real-time; mapping the data from the plurality of sensors with a micro-activity and a macro-activity; generating a message based on the mapping of the data from the plurality of sensors with the micro-activity and the macro-activity; selecting a parameter to be compared with a bit depth; tuning the parameter and the bit depth with a corresponding model based on the message; generating a parameter uncertainty array and a bit depth uncertainty array based on the tuning of the parameter and the bit depth; and generating dynamic uncertainty ellipses based on the parameter uncertainty array and the bit depth uncertainty array.

According to at least one aspect, an example system for using a real-time predictive analysis to improve monitoring of drilling operations is provided. The system can include one or more processors and at least one computer-readable storage medium having stored therein instructions which, when executed by the one or more processors, cause the system to receive data from a plurality of sensors in real-time; map the data from the plurality of sensors with a micro-activity and a macro-activity; generate a message based on the mapping of the data from the plurality of sensors with the micro-activity and the macro-activity; select a parameter to be compared with a bit depth; tune the parameter and the bit depth with a corresponding model based on the message; generate a parameter uncertainty array and a bit depth uncertainty array based on the tuning of the parameter and the bit depth; and generate dynamic uncertainty ellipses based on the parameter uncertainty array and the bit depth uncertainty array.

According to at least one aspect, an example non-transitory computer-readable storage medium for using a real-time predictive analysis to improve monitoring of drilling operations is provided. The non-transitory computer-readable storage medium can include instructions which, when executed by one or more processors, cause the one or more processors to receive data from a plurality of sensors in real-time; map the data from the plurality of sensors with a micro-activity and a macro-activity; generate a message based on the mapping of the data from the plurality of sensors with the micro-activity and the macro-activity; select a parameter to be compared with a bit depth; tune the parameter and the bit depth with a corresponding model based on the message; generate a parameter uncertainty array and a bit depth uncertainty array based on the tuning of the parameter and the bit depth; and generate dynamic uncertainty ellipses based on the parameter uncertainty array and the bit depth uncertainty array.

In some aspects, the systems, methods, and non-transitory computer-readable storage media described above can include the plurality of sensors including at least one of a bottom status sensor, a rotation sensor, a flow sensor, a pipe motion sensor, an in-slip sensor, and a duration sensor; the micro-activity including at least one of rotary drilling, slide drilling, and making a connection; the macro-activity including at least one of drilling, trip in, and trip out; the tuning of the parameter and the bit depth including at least one of a model fitting, a model evaluation, a model training, and a model testing; the method further comprising generating a parameter forecast array and a bit depth forecast array; and the generating of the dynamic uncertainty ellipses are further based on the parameter forecast array and the bit depth forecast array.

Figure 7:
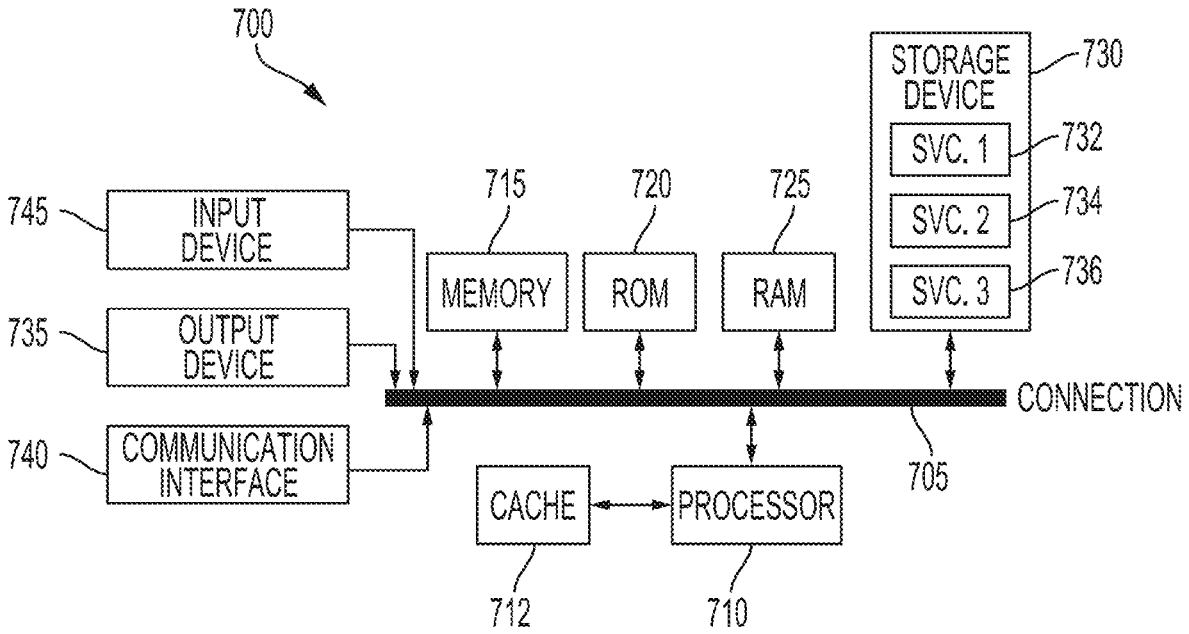
FIG. 7 is a schematic diagram of an example computing device architecture, in accordance with some examples.

As follows, the disclosure will provide a more detailed description of the systems, methods, computer-readable media and techniques herein for using a real-time predictive analysis to improve monitoring of drilling operations. The disclosure includes example systems, environments, methods, and technologies for using a real-time predictive analysis to improve monitoring of drilling operations. The disclosure concludes with a description of an example computing system architecture, as shown in FIG. 7, which can be implemented for performing computing operations and functions disclosed herein.

These variations shall be described herein as the various embodiments are set forth.

The disclosure now turns to FIG. 1A, which illustrates a schematic view of a logging while drilling (LVWD) wellbore operating environment 100 in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled with one or more wires and/or other media. The logging tools 126 may also include one or more computing devices 134 communicatively coupled with one or more of the one or more tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 1B:
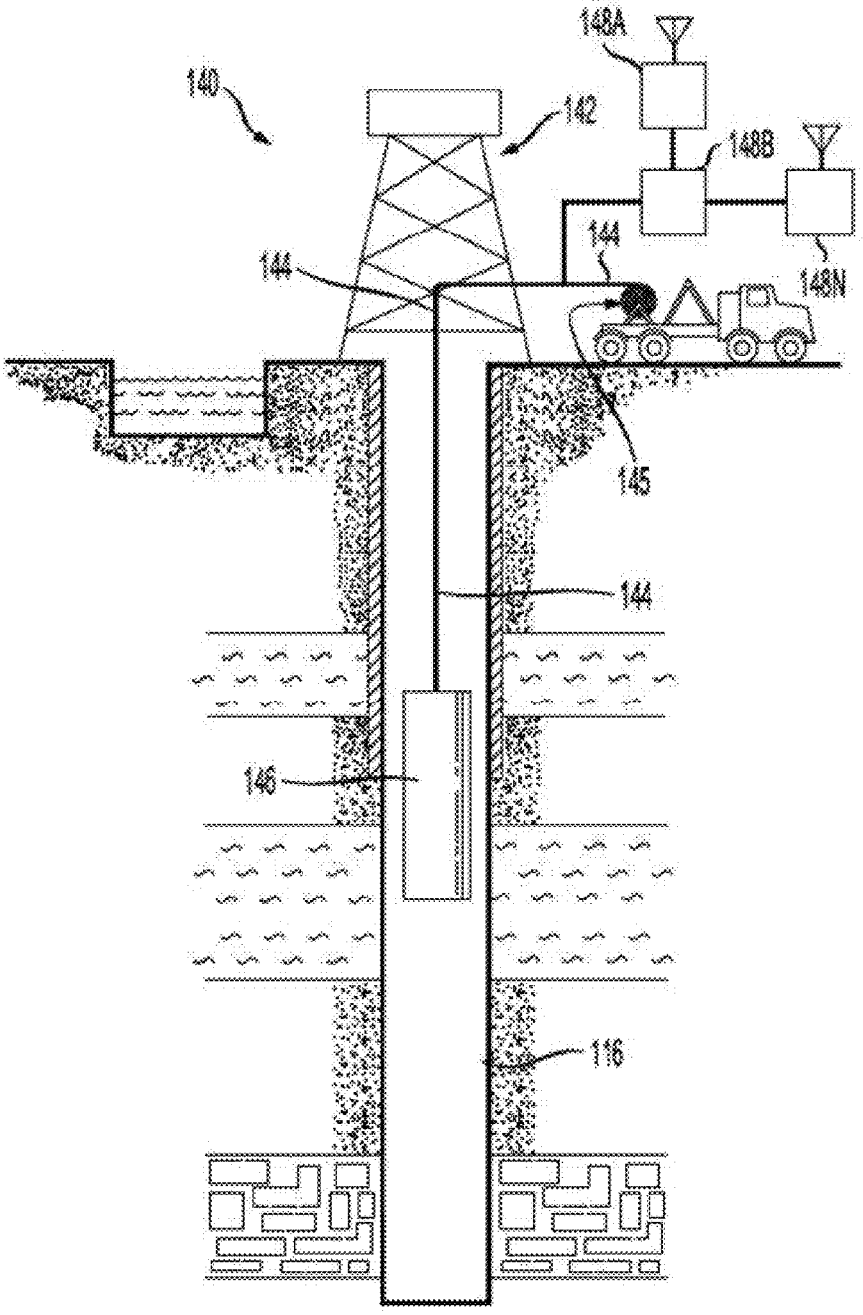
FIG. 1B is a schematic diagram of an example downhole environment having tubulars, in accordance with some examples.

Referring to FIG. 1B, an example system 140 for downhole line detection in a downhole environment having tubulars can employ a tool having a tool body 146 in order to carry out logging and/or other operations. For example, instead of using the drill string 108 of FIG. 1A to lower tool body 146, which may contain sensors or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 145 or a portable means such as a truck. The wireline conveyance 144 can include one or more wires, slicklines, cables, and/or the like, as well as tubular conveyances such as coiled tubing, joint tubing, or other tubulars.

The illustrated wireline conveyance 144 provides support for the tool, as well as enabling communication between tool processors 148A-N on the surface and providing a power supply. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
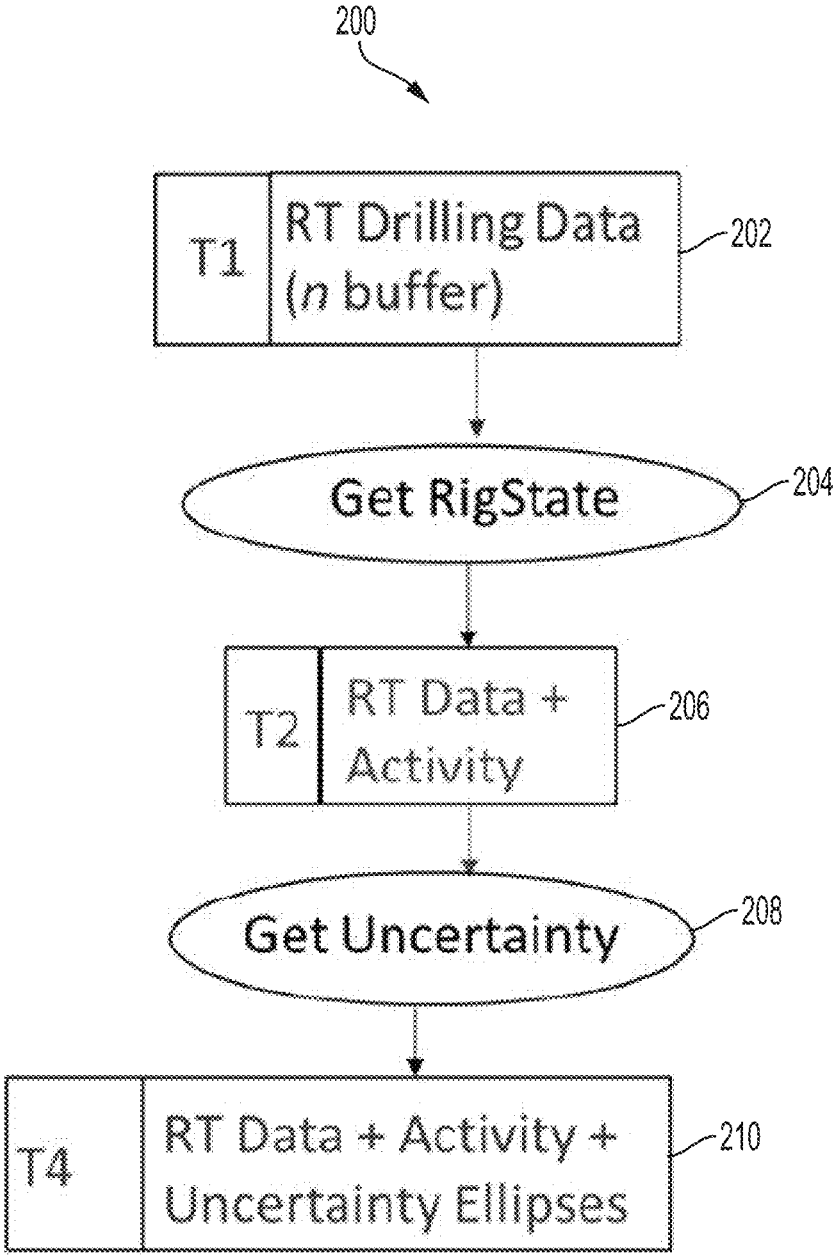
FIG. 2 is a flowchart of an example message-based software architecture configured to orchestrate data flow between various microservices, according to some aspects of the disclosed technology.

FIG. 2 is a flowchart of an example message-based software architecture configured to orchestrate data flow between various microservices, according to some aspects of the disclosed technology. The method shown in FIG. 2 is provided by way of example, as there are a variety of ways to carry out the method. Additionally, while the example method is illustrated with a particular order of steps, those of ordinary skill in the art will appreciate that FIG. 2 and the modules shown therein can be executed in any order and can include fewer or more modules than illustrated. Each module shown in FIG. 2 represents one or more steps, processes, methods, or routines in the method.

The example method shown in the flowchart of FIG. 2 can be used to overcome the previously described deficiencies of conventional monitoring techniques that make no significant effort toward predictive and/or prescriptive analysis. Specifically, and as will be discussed in greater detail later, FIG. 2 shows an example architecture coupling rig-state (e.g., i-Rigstate) and uncertainty analysis microservices.

At step 202 (T1), an example includes receiving drilling data of a drilling rig such as the wellbore operating environment 100 that can be measured in real-time (RT) at n time positions.

At step 204, the state of the drilling rig ("RigState") is assessed in real-time by receiving data from a plurality of sensors strategically placed at corresponding areas throughout the drilling rig. Statistical data along with micro and macro activity mapping are evaluated to provide real-time data messages relating to the activity. Further details and descriptions of the RigState is provided below in FIGS. 3A and 3B.

At step 206 (T2), the above-mentioned real-time data and corresponding activities are provided from step 204.

At step 208, the uncertainty of the drilling rig is assessed in real-time by receiving the real-time data and activity information at various time positions from step 206. The uncertainty of the drilling rig considers a Y array and a bit depth array at different positions. Thereafter, an automatic model hyper-parameter tuning is performed with the data received from the Y array and bit depth array to perform a model of fitting, training, evaluating, and testing. With this data, a forecast is predicted of the Y array, a Y uncertainty array, the bit depth array, and a bit depth uncertainty array to provide real-time data messages that correspond to the activity, forecast, and forecast uncertainty.

Further details and descriptions of the RigState is provided below in FIGS. 3A and 3B.

At step 210 (T4), with the data and information provided by step 208, uncertainty ellipses can be produced to assist in real-time predictions and adjustments of the drilling rig.

Figure 3A:
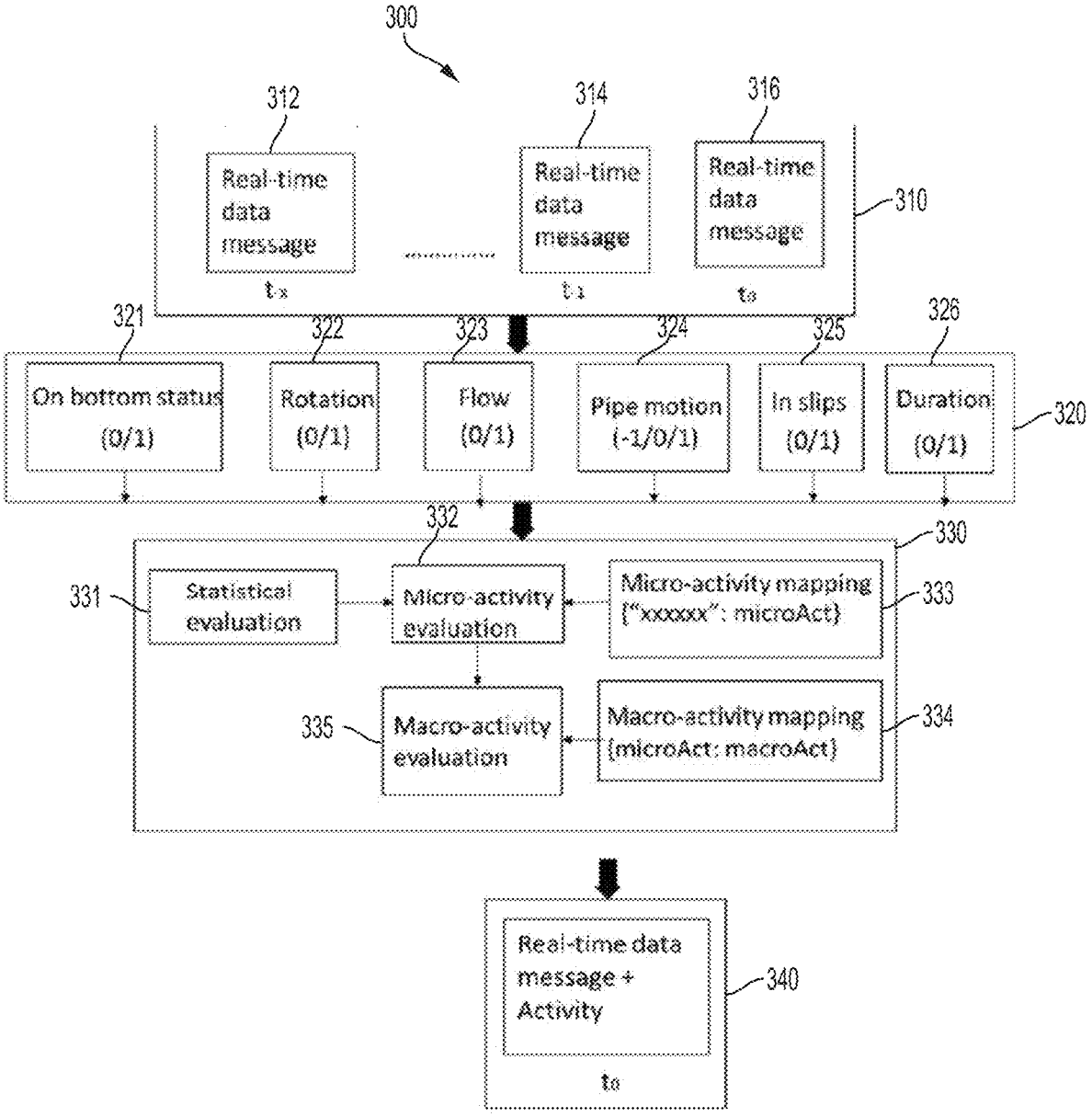
FIG. 3A is a flowchart of a rig-state workflow, according to some aspects of the disclosed technology.

FIG. 3A is a flowchart of a rig-state (i-Rigstate) workflow, according to some aspects of the disclosed technology. The method shown in FIG. 3A is provided by way of example, as there are a variety of ways to carry out the method. Additionally, while the example method is illustrated with a particular order of steps, those of ordinary skill in the art will appreciate that FIG. 3A and the modules shown therein can be executed in any order and can include fewer or more modules than illustrated. Each module shown in FIG. 3A represents one or more steps, processes, methods, or routines in the method.

At step 310, the example workflow of FIG. 3A shows an example where at tO (time=0) arrays of up to X prior messages data can be measured in real-time 312, 314, 316. Examples of real-time data of the drilling rig includes the position and rotation of the drill bit.

At step 320, current messages from a real-time data acquisition tool can be continuously collected and assessed based on six criteria that answer the following questions: (1) is the bit on the bottom; (2) is the bit rotating; (3) is there flow in the wellbore; (4) is the pipe moving up, static, or moving down; (5) are the slips in or not; and (6) is the micro-activity brief or long? For example, a plurality of sensors can collect and assess the above-mentioned inquiries. One sensor 321 can measure the position of the drill bit in relation to the bottom of the wellbore. Another sensor 322 can measure a rotational speed of the drill bit. Yet another sensor 323 can measure whether there is a flow of fluid in the wellbore. A different sensor 324 can measure the relative position of the pipe to determine whether the pipe is moving up, static, or moving down. Another sensor 325 can measure whether the slips are in or not. While a separate sensor 326 can measure whether the micro-activity is brief or long.

Though each of the above-mentioned sensors are individual sensors that can measure their corresponding parameters, one sensor can also be configured to measure all, some, or more of the above-mentioned parameters. The above-mentioned sensors can provide encoded data signals to the wellbore environment 100 that correspond to 0, 1, or −1.

At step 330, in some aspects, an encoded answer to the six questions can yield a micro-activity evaluation 332 for each message via mapping 333. A statistical evaluation 331 can be performed on the interval of size X and the micro-activity over the interval is determined. Examples of micro-activities can include rotary drilling, slide drilling, making connection, and any other micro-activity suitable for the intended purpose and understood by a person of ordinary skill in the art. That micro-activity 332 coupled with the macro-activity mapping 334 can yield the macro activity evaluation 335 over the entire interval. Examples of macro-activities can include drilling, trip in, trip out, and any other macro-activity suitable for the intended purpose and understood by a person of ordinary skill in the art.

At step 340, both the macro and micro activities 330 are appended to the original real-time data message 320 at the current calculation time and returned as a new message to be consumed by a subsequent micro-service. An example of the new message is provided below in JavaScript Object Notation (JSON) format. New parameters can be appended in each section of a logData as an output message.

```
{
"rtsMessage": {
"header": {
  "correlationId": "68445413-24ea-4683-bcfc-lfbd9dl572b5",
  "originatingMachine": "np2rtos603v",
  "originatingIP": "https://protect-us.mimecast.com/s/LL73C82BqpCm7OnMC17zxm",
  "objectKlass": "com.halliburton.domain.rtlog1411",
  "operation": "Add",
  "timestamp": "au003d2019-08-01T02:37:36.744 #au003d2019-07-31T20:37:36.743 #stu003d2019-07-31T20:37:36.801 #steu003d2019-07-31T20:37:36.809"
},
"body": {
  "rtlogl4ll": {
```

"wellUid": "245eb9cc-ab8b-4864-b53f-0fba353566c7",
"wellboreUid": "ebd23527-dbb1-42d5-bca7-c3e148f8dc74",
"logUid": "aab5cb4d-b154-40b2-99e2-e64d3b86ce96",
"logType": "Depth",
"logData": {
"mnemonicList": [
"ANN PRESSURE",
"AVG_ROP_FT_HR",
"BIT DEPTH",
"BIT DPT MD",
"BIT_ON_BTM",
"BIT_RPM",
"BLOCK POS",
"DENS_IN",
"DENS OUT",
"DIFF PRESS",
"FAST_ROP_FT_HR",
"FLOW_IN",
"FLOW OUT",
"GAMMA_RAY_DEPTH",
"GAS_C1",
"GAS_C2",
"GAS_C3",
"GAS TOTAL",
"HOOKLOAD MAX",
"MP1_SPM",
"MP1_STK",
"MP2 SPM",
"MP2_STK",
"MP3_SPM",
"MP3_STK",
"SLIPS STAT",
"STP_PRS_1",
"TANK1_VOL",
"TANK2 VOL",
"TANK3_VOL",
"TANK4_VOL",
"TANK5 VOL",
"TD_SPEED",
"TD TORQUE",
"TOTAL_GAS_GW",
"TOT_DPT_MD",
"TOT_SPM",
"TT1 VOL",
"TT2_VOL",
"TT_VOL",
"1TVD",
"W:TOT_DPT MD U",
"WOB"
],
"mnemonicIdList":[
"b4ec1ffl-0df6-3b23-b6d2-adeaa41a4c68",
"b5d9e691-e9dl-3e9b-953e-350a30de5b28",
"85f504c8-0704-3c8a-8dca-d55e3702a32a",
"ff0ea182-6ce7-3291-b35e-a44ba164c0ad",
"0a5a659d-e82f-3cfb-bbO2-5f41b334c3b5",
"4acfdf0c-5a8f-3ed6-9c6f-b54c7bc7c444",
"238b21e2-a59c-320b-816e-4cc2e02d2637",
"5093f7c0-ce83-334d-9845-e9d476a8e608",
"lae752f4-eec5-3753-bf93-bab44fe4059e",
"f8d63c32-8efl-3370-813f-b445c5508f88",
"3c088fl7-4d84-333a-bf45-d7209d5ae8d7",
"931a8db8-38f9-3d76-8cd1-14b92d347d0c",
"c661d037-7df7-3f67-b338-927e69eb9573",
"000c70de-d1df-3aaa-8b6c-6218043053ce",
"94c19558-d508-37f5-99c9-226c9e5c7cb8",
"ac33482d-0650-334a-b528-dld08984a350",
"f4e3f022-4aba-39bf-aab0-b25ae3 Of960a",
"994f7023-ObOb-3826-9558-484ce756a9c3",
"4faae507-1063-3c7a-835b-6e10ed4cb401",
"fa86cca8-8ab3-396f-9e3f-6f07ba9f5615",
"dd118ac8-a56a-3a08-b9f4-d0e32e2ed176",
"db9bbd72-71el-3f21-b29c-46cfb6dec245",
"2569bb7f-8460-349d-b564-49a075264fb7",
"391c4c50-41fc-3842-93e7-3bf03bdfba3f",
"lbba9f57-ba87-342b-ba89-24885a51c52b",
"2d33197b-e733-3609-a70b-35c2d925e3ce",
"ea766e8a-aca9-3f4f-9539-e4a83e622e99",
"1445dad7-370d-3014-8dbe-775c829b1558",
"c99c5abf-aa9b-377e-8794-336ba1129935",
"c693bla3-3566-35bf-9508-0208be190eaf",
"5d16bdab-e572-3e36-9675-c8574a213dd7",
"45d02249-4c20-3011-a210-50c587a63e5d",
"deb064d6-873b-3bb8-b87c-780106571b35",
"b123b865-e834-3c66-9a22-c57c05445f00",
"72c92e68-c9b4-306f-9930-la6778a8eb15",
"dOlc49be-31e9-35f5-924a-a4d5ae19e313",
"1ea2d999-f82c-31fb-aae7-7caa994149a3",
"959250b1-c358-3f40-a589-552771e49ad5",
"al lbd9ea-5a7f-3710-8c6e-d8447fa9ed24",
"4bd541e9-alc2-39b3-94ae-cf4b7bb851f3",
"d90672a9-f4bb-3b6a-a4dc-96ed2b419af0",
"a8b153b1-1849-3945-a059-7a563c63591e",
"1fb27876-0154-3e56-9b33-d22cf0aeaa7f"
],
"variableList": [
"Time u0026 Date",
"Depth",
"W:ANN_PRESSUR_U",
"W:AVG ROP FT U",
"W:BIT DEPTH U",
"W:BIT_DPT_MD_U",
"W:BIT_ON_BTM_U",
"W:BIT RPM U",
"W:BLOCK_POS_U",
"W:DENS_IN_U",
"W:DENS OUT U",
"W:DIFF_PRESS_U",
"W:FAST_ROP_FT_U",
"W:FLOW IN U",
"W:FLOW_OUT_U",
"W: GAMMA_RAY_D U",
"W:GAS_C1 U",
"W:GAS_C2_U",
"W:GAS_C3_U",
"W:GAS TOTAL U",
"W:HOOKLOAD_MA U",
"W:MP1_SPM_U",
"W:MP1 STK U",
"W:MP2_SPM_U",
"W:MP2_STK_U",
"W:MP3 SPM U",
"W:MP3_STK_U",
"W:SLIPS_STAT_U",
"W:STP_PRS 1 U",
"W:TANK1 VOL U",
"W:TANK2_VOL_U",
"W: TANK3_VOL_U",
"W:TANK4 VOL U",
"W: TANK5_VOL_U",
"W: TD_SPEED_U", "W:TD_TORQUE U",
"W:TOTAL_GAS_G_U",
"Depth",
"W:TOT SPM U",
"W:TT1_VOL_U",
"W:TT2_VOL_U",
"W:TT VOL U",
"W:TVD_U",
"Hole Depth",
"W:WOB U"
],
"unitList": [
"ms",
"ft",
"psf",
"fps",
"ft",
"ft",
"unitless",
"dps",
"ft",
"pef",
"pef",
"psf",
"fps",
"cfps",
"cfps",
"ft"
"unit",
"unit",
"unit",
"unit",
"lbs",
"unitless",
"unitless",
"unitless",
"unitless",
"unitless",
"unitless",
"unitless",
"psf",
"ft3",
"ft3",
"ft3",
"ft3",
"ft3",
"dps",
"f-p"
"unit",
"ft"
"stks",
"ft3",
"unitless",
"ft3",
"ft"
"ft"
"lbs"
],
"unitTypeList": [
"Time u0026 Date",
"Depth",
"Pressure",
"Drill rate",
"Depth",
"Depth",
"Unitless",
"Rotary Speed",
"Depth",
"Mud density",
"Mud density",
"Pressure",
"Drill rate",
"Mud flow",
"Mud flow",
"Depth",
"Gas unit type",
"Gas unit type",
"Gas unit type",
"Gas unit type",
"Hook weights",
"Unitless",
"Unitless",
"Unitless",
"Unitless",
"Unitless",
"Unitless",
"Pump pressure",
"Pit volume",
"Pit volume",
"Pit volume",
"Pit volume",
"Pit volume",
"Rotary Speed",
"Rotary torque",
"Gas unit type",
"Depth",
"Pump stroke",
"Abrasive Volume",
"Unitless",
"Abrasive Volume",
"Depth",
"Depth",
"Hook weights"
],
"dataTypeList": [
"long",
"double",
"double",
"double",
"double",
"double",
"double",
"double",
"double",
"float",
"double",
"float",
"double",
"double",
"double",
"double",
"double",
"double",
"double",
"double",
"double",
"double",
"double",
"double",
"double",
"double",
"double", "double",
"double",
"double",
"double",
"double",
"double",
"double",
"double",
"double",
"double",
"double",
"double",
"double",
"double",
"double",
"float",
"double"
],
"data": [
[
999.25,
1340.0,
0.0,
0.04574127777777778,
1340.502,
1340.281,
1.0,
0.0,
63.03071,
14.600000381469727,
0.0,
22522.08984375,
0.04556861111111111,
1.5837096440710896,
0.0,
0.0,
0.0,
0.0,
0.0,
0.0,
97997.51000000001,
84.70977,
1254160.0,
85.12006,
2167430.0,
0.0,
0.0,
1.0,
296032.4640000002,
574.9187569761201,
402.2778365437522,
893.262275164002,
1217.4668571133404,
0.0,
0.0,
0.0,
−0.1,
1340.0,
169.7875,
0.0,
0.0,
0.0,
1339.673,
0.0,
8065.243
]
]
}
}
}
}
}
}

Figure 3B:
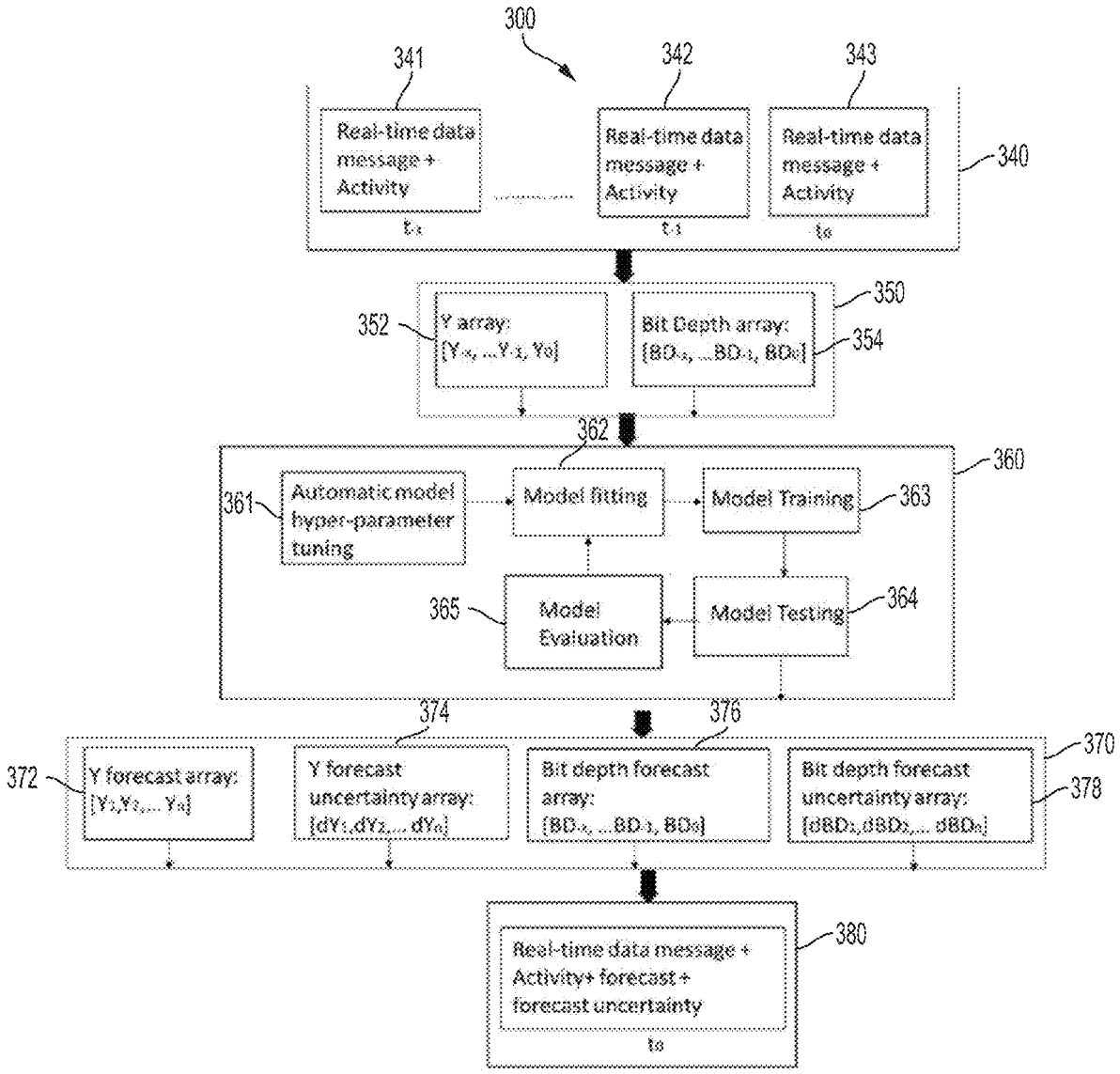
FIG. 3B is a flowchart of an uncertainty analysis performed by a rig-state workflow, according to some aspects of the disclosed technology.

FIG. 3B is a flowchart of an uncertainty analysis performed by a rig-state workflow, according to some aspects of the disclosed technology. The method shown in FIG. 3B is provided by way of example, as there are a variety of ways to carry out the method. Additionally, while the example method is illustrated with a particular order of steps, those of ordinary skill in the art will appreciate that FIG. 3B and the modules shown therein can be executed in any order and can include fewer or more modules than illustrated. Each module shown in FIG. 3B represents one or more steps, processes, methods, or routines in the method.

At step 340, in some approaches, the uncertainty analysis micro-service aims at forecasting the next n points in a 2-D plot of drilling parameters utilizing the real-time data messages and activities 340.

At step 350, for instance, FIG. 3B presents the workflow for the uncertainty analysis micro-service on parameters Y 352 and bit depth 354. In this example, an array of up to X prior messages and the current message from the iRigstate are consumed to obtain individual arrays for the two parameters of interest (Y array 352 and bit depth array 354) for the uncertainty analysis. The uncertainty of the drilling rig can consider the Y array 352 and the bit depth array 354 at different times and positions.

At step 360, real-time drilling data are independent, time-based, and the measurements can be collected at an approximately constant rate. An automatic model hyper-parameter tuning 361 can be performed with the data received from the Y array 352 and the bit depth array 354 to perform a model of fitting 362, training 363, evaluating 365, and testing 364. For example, the automatic model hyper-parameter 361 can begin with the model fitting 362, which can provide a model that corresponds to the Y array 352 and the bit depth array 354. The model can then be trained 363 and compared with the real-time data from the Y array 352 and the bit depth array 354. The results can then be tested 364 for accuracy and accurateness.

At step 370, the data 340 can be treated as time series data. A time series forecast model can be developed for every parameter of interest (e.g., Y parameter). With this data 340, a forecast can be predicted for the Y array 372, a Y uncertainty array 374, the bit depth array 376, and a bit depth uncertainty array 378 to provide real-time data messages that correspond to the activity, forecast, and forecast uncertainty of the system.

An Auto Regressive Integrated Moving Average (ARIMA) model can be utilized to improve the accuracy of the predictions of step 370 by automatically tuning the following parameters (p, d, and q). The below-referenced parameters of the ARIMA model can be defined as follows:

p: The number of lag observations included in the ARIMA model (i.e., lag order).

d: The number of times that raw observations are differenced (i.e., degree of differencing).

q: The size of a moving average window (i.e., order of moving average).

The p, d, and q parameters as described above can also be processed through the automatic hyper-parameter tuning 361 of step 360. Below is an example of output messages of an uncertainty analysis of mechanical specific energy (MSE) and friction factor as examples of Y parameters. The appended data at the end of the below-referenced logData sections can be used to construct uncertainty ellipses as illustrated in FIGS. 4 and 5.

At step 380, the forecast model can provide a prediction on the next n values for each parameter, as well as the uncertainty and prediction interval for each value at any specified confidence level. For example, in FIGS. 4 and 5, uncertainty ellipses can be generated that vary in size depending on the uncertainty of the forecast model. When a confidence level is high, the uncertainty ellipse can be relatively small. When a confidence level is low, the uncertainty ellipse can be relatively large. For example, the confidence level of the flow rate measured by the sensor 323 is high when the bit depth 354 is not deep. However, as the bit depth 354 increases, the confidence level of the flow rate measured by the sensor 323 decreases. As such, in this example, the confidence level can be inversely proportional to uncertainty. The higher the confidence level, the smaller the uncertainty ellipse. The lower the confidence level, the larger the uncertainty ellipse.

Figure 4:
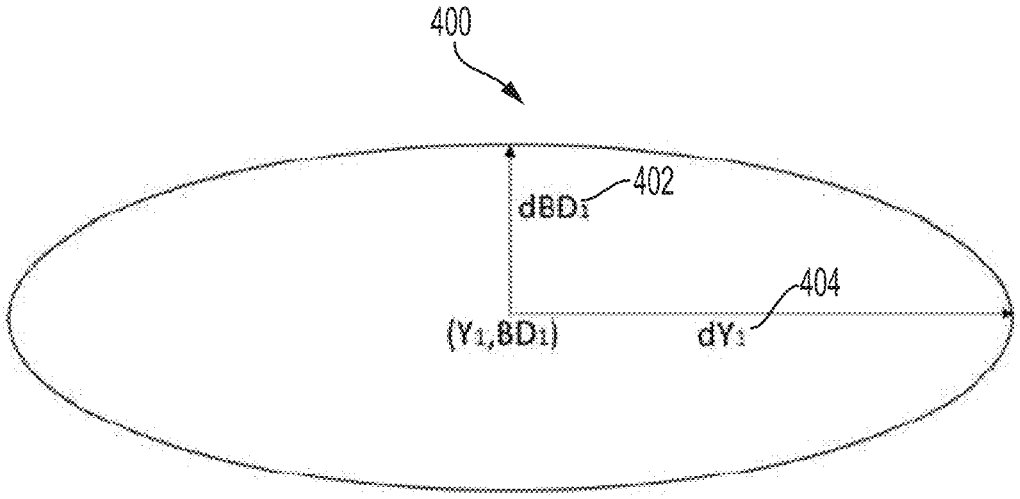
FIG. 4 is an example of an uncertainty ellipse based on results from an uncertainty analysis, according to some aspects of the disclosed technology.
Figure 5:
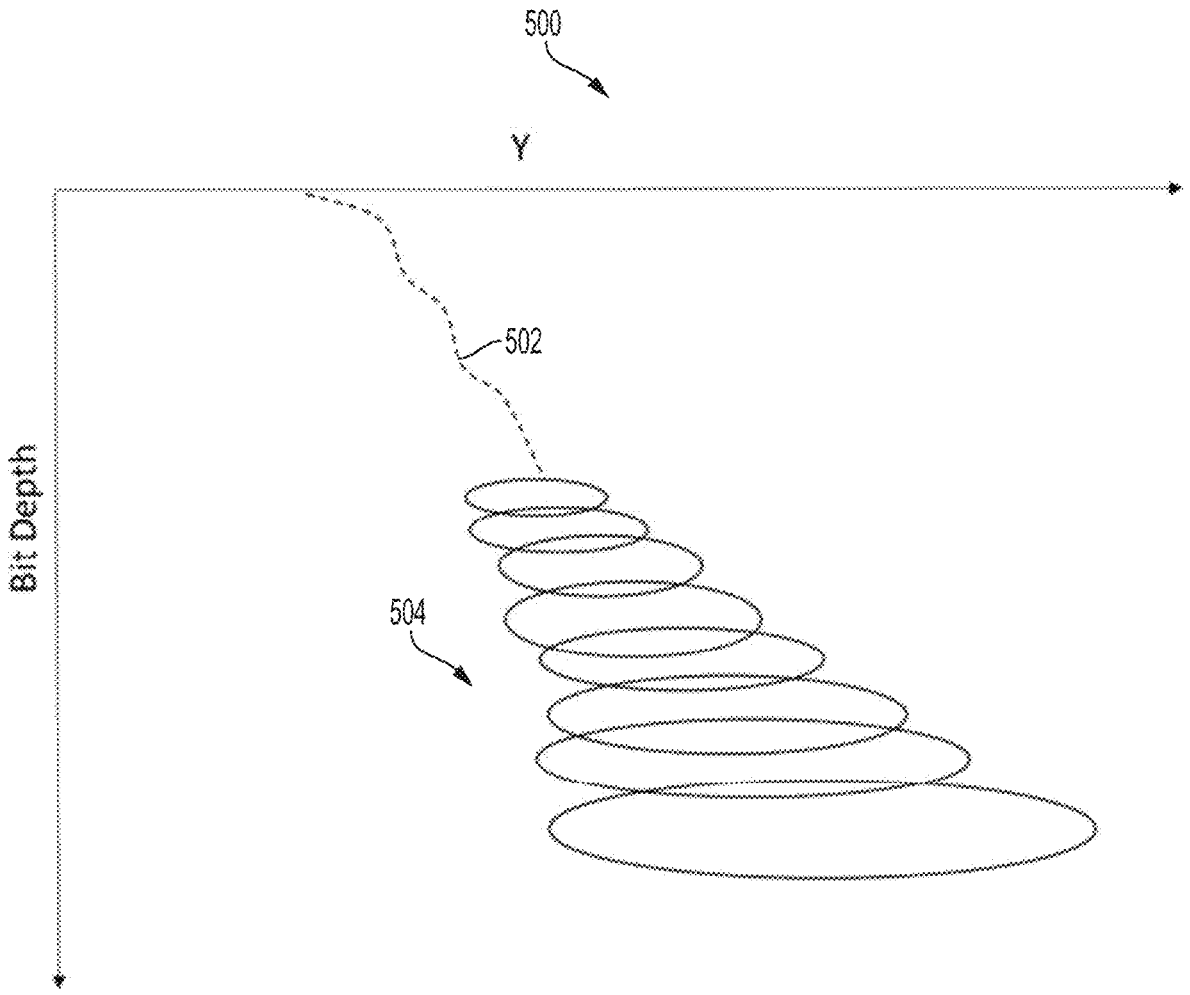
FIG. 5 is an example visualization for an uncertainty analysis, according to some aspects of the disclosed technology.

By combining each predicted 2-D point with uncertainty in every dimension, an ellipse can be built as shown in FIG. 4. Specifically, FIG. 4 is an example of an uncertainty ellipse based on results from an uncertainty analysis 380, according to some aspects of the disclosed technology.

In some approaches, this ellipse can represent the prediction area for a forecasted point (center) at a specific confidence level as described above. The n predicted values can yield n ellipses for a confidence level. As shown in FIG. 4, a first axis 402 can be the change in the bit depth, while a second axis 404 can be the change in the Y parameter.

As described above, the Y parameter can be any parameter of interest including the bottom status 321, the rotation 322, the flow 323, the pipe motion 324, the in slips 325, the duration 326, friction, hook load, torque, MSE, or any other parameter suitable for the intended purpose and understood by a person of ordinary skill in the art.

These ellipses can be displayed alongside the real time data 502 in a real-time dashboard similar to the plot shown in FIG. 5. Specifically, FIG. 5 illustrates an example of a visualization representing uncertainty analysis with uncertainty ellipses 504 of varying sizes, according to some aspects of the disclosed technology. The smaller uncertainty ellipses 504 can demonstrate a high confidence level of the Y parameter, while the larger uncertainty ellipses 504 can demonstrate a low confidence level of the Y parameter. As provided above, the deeper the bit depth, the lower the confidence level (larger uncertainty ellipses) can be as the uncertainty of the surrounding and corresponding parameters increases.

Figure 6:
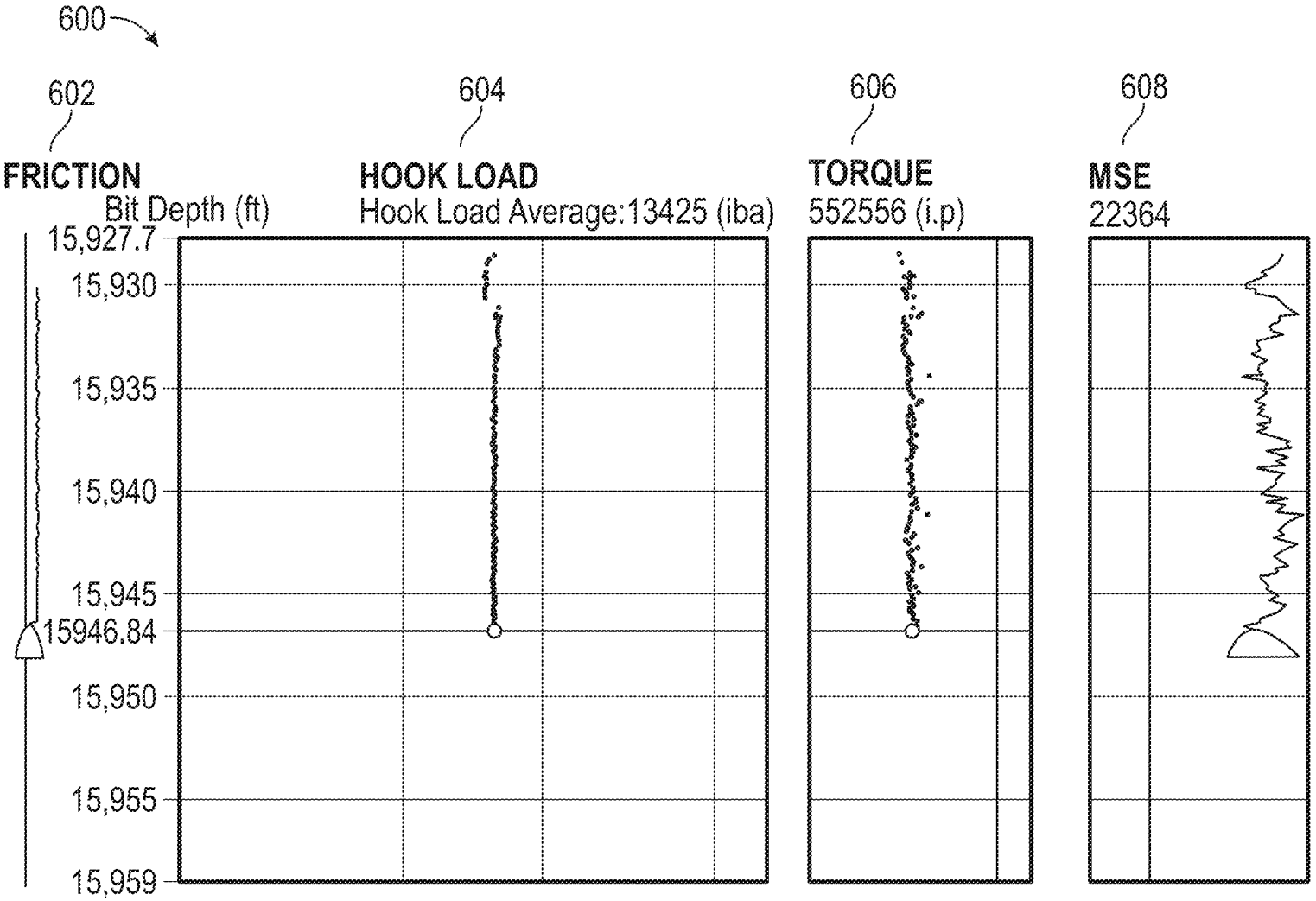
FIG. 6 is an example visualization for the uncertainty analysis of FIG. 5 in relation to bit depth, according to some aspects of the disclosed technology.

FIG. 6 is an example visualization for the uncertainty analysis of FIG. 5 in relation to bit depth, according to some aspects of the disclosed technology. The example illustrates plots $^{ID}C\text{-}^{B}2,^{AMD}$ of various parameters that can correspond to the uncertainty ellipses of FIG. 5. Examples of parameters plotted against a bit depth illustrated in FIG. 6 can include a 2D plot representation of a friction factor versus a bit depth 602, a hook load versus a bit depth 604, a torque versus a bit depth 606, and a mechanical specific energy versus a bit depth 608.

Having disclosed example systems, methods, and technologies for using a real-time predictive analysis to improve monitoring of drilling operations, the disclosure now turns to FIG. 7, which illustrates an example computing device architecture 700 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 7 illustrates an example computing device architecture 700 of a computing device which can implement the various technologies and techniques described herein. For example, the computing device architecture 700 can implement the above-mentioned systems and perform various steps, methods, and techniques disclosed herein. The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random access memory (RAM) 725, to the processor 710.

The computing device architecture 700 can include a cache 712 of high-speed memory connected directly with, in close proximity to, or integrated as part of the processor 710. The computing device architecture 700 can copy data from the memory 715 and/or the storage device 730 to the cache 712 for quick access by the processor 710. In this way, the cache 712 can provide a performance boost that avoids processor 710 delays while waiting for data. These and other modules can control or be configured to control the processor 710 to perform various actions. Other computing device memory 715 may be available for use as well. The memory 715 can include multiple different types of memory with different performance characteristics. The processor 710 can include any general purpose processor and a hardware or software service, such as service 1 732, service 2 734, and service 3 736 stored in storage device 730, configured to control the processor 710 as well as a special-purpose processor where software instructions are incorporated into the processor design. The processor 710 may be a self-contained system, containing multiple cores or processors, a bus, memory controller, cache, etc. A multi-core processor may be symmetric or asymmetric.

To enable user interaction with the computing device architecture 700, an input device 745 can represent any number of input mechanisms, such as a microphone for speech, a touch-sensitive screen for gesture or graphical input, keyboard, mouse, motion input, speech and so forth. An output device 735 can also be one or more of a number of output mechanisms known to those of skill in the art, such as a display, projector, television, speaker device, etc. In some instances, multimodal computing devices can enable a user to provide multiple types of input to communicate with the computing device architecture 700. The communications interface 740 can generally govern and manage the user input and computing device output. There is no restriction on operating on any particular hardware arrangement and therefore the basic features here may easily be substituted for improved hardware or firmware arrangements as they are developed.

Storage device 730 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 can include services 732, 734, 736 for controlling the processor 710. Other hardware or software modules are contemplated. The storage device 730 can be connected to the computing device connection 705. In one aspect, a hardware module that performs a particular function can include the software component stored in a computer-readable medium in connection with the necessary hardware components, such as the processor 710, connection 705, output device 735, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like.

However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors.

Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal.

Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not to be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A method comprising receiving data from a plurality of sensors in real-time; mapping the data from the plurality of sensors with a micro-activity and a macro-activity; generating a message based on the mapping of the data from the plurality of sensors with the micro-activity and the macro-activity; selecting a parameter to be compared with a bit depth; tuning the parameter and the bit depth with a corresponding model based on the message; generating a parameter uncertainty array and a bit depth uncertainty array based on the tuning of the parameter and the bit depth; and generating dynamic uncertainty ellipses based on the parameter uncertainty array and the bit depth uncertainty array.

Statement 2: A method according to Statement 1, wherein the plurality of sensors includes at least one of a bottom status sensor, a rotation sensor, a flow sensor, a pipe motion sensor, an in-slip sensor, and a duration sensor.

Statement 3: A method according to any of Statements 1 and 2, wherein the micro-activity includes at least one of rotary drilling, slide drilling, and making a connection.

Statement 4: A method according to any of Statements 1 through 3, wherein the macro-activity includes at least one of drilling, trip in, and trip out.

Statement 5: A method according to any of Statements 1 through 4, wherein the tuning of the parameter and the bit depth includes at least one of a model fitting, a model evaluation, a model training, and a model testing.

Statement 6: A method according to any of Statements 1 through 5, further comprising generating a parameter forecast array and a bit depth forecast array.

Statement 7: A method according to any of Statements 1 through 6, wherein the generating of the dynamic uncertainty ellipses are further based on the parameter forecast array and the bit depth forecast array.

Statement 8: A system comprising one or more processors and at least one computer-readable storage medium having stored therein instructions which, when executed by the one or more processors, cause the system to: receive data from a plurality of sensors in real-time; map the data from the plurality of sensors with a micro-activity and a macro-activity; generate a message based on the mapping of the data from the plurality of sensors with the micro-activity and the macro-activity; select a parameter to be compared with a bit depth; tune the parameter and the bit depth with a corresponding model based on the message; generate a parameter uncertainty array and a bit depth uncertainty array based on the tuning of the parameter and the bit depth; and generate dynamic uncertainty ellipses based on the parameter uncertainty array and the bit depth uncertainty array.

Statement 9: A system according to Statement 8, wherein the plurality of sensors includes at least one of a bottom status sensor, a rotation sensor, a flow sensor, a pipe motion sensor, an in-slip sensor, and a duration sensor.

Statement 10: A system according to any of Statements 8 and 9, wherein the micro-activity includes at least one of rotary drilling, slide drilling, and making a connection.

Statement 11: A system according to any of Statements 8 through 10, wherein the macro-activity includes at least one of drilling, trip in, and trip out.

Statement 12: A system according to any of Statements 8 through 11, wherein the tuning of the parameter and the bit depth includes at least one of a model fitting, a model evaluation, a model training, and a model testing.

Statement 13: A system according to any of Statements 8 through 12, further comprising generating a parameter forecast array and a bit depth forecast array.

Statement 14: A system according to any of Statements 8 through 13, wherein the generating of the dynamic uncertainty ellipses are further based on the parameter forecast array and the bit depth forecast array.

Statement 15: A non-transitory computer-readable storage medium comprising instructions stored on the non-transitory computer-readable storage medium, the instructions, when executed by one more processors, cause the one or more processors to: receive data from a plurality of sensors in real-time; map the data from the plurality of sensors with a micro-activity and a macro-activity; generate a message based on the mapping of the data from the plurality of sensors with the micro-activity and the macro-activity; select a parameter to be compared with a bit depth; tune the parameter and the bit depth with a corresponding model based on the message; generate a parameter uncertainty array and a bit depth uncertainty array based on the tuning of the parameter and the bit depth; and generate dynamic uncertainty ellipses based on the parameter uncertainty array and the bit depth uncertainty array.

Statement 16: A non-transitory computer-readable storage medium according to Statement 15, wherein the plurality of sensors includes at least one of a bottom status sensor, a rotation sensor, a flow sensor, a pipe motion sensor, an in-slip sensor, and a duration sensor.

Statement 17: A non-transitory computer-readable storage medium according to any of Statements 15 and 16, wherein the micro-activity includes at least one of rotary drilling, slide drilling, and making a connection.

Statement 18: A non-transitory computer-readable storage medium according to any of Statements 15 through 17, wherein the macro-activity includes at least one of drilling, trip in, and trip out.

Statement 19: A non-transitory computer-readable storage medium according to any of Statements 15 through 18, wherein the tuning of the parameter and the bit depth includes at least one of a model fitting, a model evaluation, a model training, and a model testing.

Statement 20: A non-transitory computer-readable storage medium according to any of Statements 15 through 19, further comprising generating a parameter forecast array and a bit depth forecast array.

Statement 21: A non-transitory computer-readable storage medium according to any of Statements 15 through 20, wherein the generating of the dynamic uncertainty ellipses are further based on the parameter forecast array and the bit depth forecast array.

Statement 22: A system comprising means for performing a method according to any of Statements 1 through 21.

What is claimed is:

1. A computer-implemented method comprising:

receiving data from a plurality of sensors in real-time;

mapping the data from the plurality of sensors with a micro-activity and a macro-activity;

generating a message based on the mapping of the data from the plurality of sensors with the micro-activity and the macro-activity;

selecting a parameter to be compared with a bit depth;

tuning the parameter and the bit depth with a corresponding model based on the message;

generating a parameter uncertainty array and a bit depth uncertainty array based on the tuning of the parameter and the bit depth;

generating dynamic uncertainty ellipses based on the parameter uncertainty array and the bit depth uncertainty array; and controlling a drilling operation in a wellbore based on the dynamic uncertainty ellipses.

2. The computer-implemented method of claim 1, wherein the plurality of sensors includes at least one of a bottom status sensor, a rotation sensor, a flow sensor, a pipe motion sensor, an in-slip sensor, and a duration sensor.

3. The computer-implemented method of claim 1, wherein the micro-activity includes at least one of rotary drilling, slide drilling, and making a connection.

4. The computer-implemented method of claim 1, wherein the macro-activity includes at least one of drilling, trip in, and trip out.

5. The computer-implemented method of claim 1, wherein the tuning of the parameter and the bit depth includes at least one of a model fitting, a model evaluation, a model training, and a model testing.

6. The computer-implemented method of claim 1, further comprising generating a parameter forecast array and a bit depth forecast array.

7. The computer-implemented method of claim 6, wherein the generating of the dynamic uncertainty ellipses are further based on the parameter forecast array and the bit depth forecast array.

8. A system comprising:

one or more processors; and at least one computer-readable storage medium having stored therein instructions which, when executed by the one or more processors, cause the system to:

receive data from a plurality of sensors in real-time;

map the data from the plurality of sensors with a micro-activity and a macro-activity;

generate a message based on the mapping of the data from the plurality of sensors with the micro-activity and the macro-activity;

select a parameter to be compared with a bit depth;

tune the parameter and the bit depth with a corresponding model based on the message;

generate a parameter uncertainty array and a bit depth uncertainty array based on the tuning of the parameter and the bit depth;

generate dynamic uncertainty ellipses based on the parameter uncertainty array and the bit depth uncertainty array; and control a drilling operation in a wellbore based on the dynamic uncertainty ellipses.

9. The system of claim 8, wherein the plurality of sensors includes at least one of a bottom status sensor, a rotation sensor, a flow sensor, a pipe motion sensor, an in-slip sensor, and a duration sensor.

10. The system of claim 8, wherein the micro-activity includes at least one of rotary drilling, slide drilling, and making a connection.

11. The system of claim 8, wherein the macro-activity includes at least one of drilling, trip in, and trip out.

12. The system of claim 8, wherein the tuning of the parameter and the bit depth includes at least one of a model fitting, a model evaluation, a model training, and a model testing.

13. The system of claim 8, further comprising generating a parameter forecast array and a bit depth forecast array.

14. The system of claim 13, wherein the generating of the dynamic uncertainty ellipses are further based on the parameter forecast array and the bit depth forecast array.

15. A non-transitory computer-readable storage medium comprising:

instructions stored on the non-transitory computer-readable storage medium, the instructions, when executed by one more processors, cause the one or more processors to:

receive data from a plurality of sensors in real-time;

map the data from the plurality of sensors with a micro-activity and a macro-activity;

generate a message based on the mapping of the data from the plurality of sensors with the micro-activity and the macro-activity;

select a parameter to be compared with a bit depth;

tune the parameter and the bit depth with a corresponding model based on the message;

generate a parameter uncertainty array and a bit depth uncertainty array based on the tuning of the parameter and the bit depth;

generate dynamic uncertainty ellipses based on the parameter uncertainty array and the bit depth uncertainty array; and control a drilling operation in a wellbore based on the dynamic uncertainty ellipses.

16. The non-transitory computer-readable storage medium of claim 15, wherein the plurality of sensors includes at least one of a bottom status sensor, a rotation sensor, a flow sensor, a pipe motion sensor, an in-slip sensor, and a duration sensor.

17. The non-transitory computer-readable storage medium of claim 15, wherein the micro-activity includes at least one of rotary drilling, slide drilling, and making a connection.

18. The non-transitory computer-readable storage medium of claim 15, wherein the macro-activity includes at least one of drilling, trip in, and trip out.

19. The non-transitory computer-readable storage medium of claim 15, further comprising generating a parameter forecast array and a bit depth forecast array.

20. The non-transitory computer-readable storage medium of claim 19, wherein the generating of the dynamic uncertainty ellipses are further based on the parameter forecast array and the bit depth forecast array.

* * * * *